United States Patent [19]

Michlmayr

[11] 4,188,285

[45] Feb. 12, 1980

[54] SELECTIVE PROCESS FOR REMOVAL OF THIOPHENES FROM GASOLINE USING A SILVER-EXCHANGED FAUJASITE-TYPE ZEOLITE

[75] Inventor: Manfred J. Michlmayr, Orinda, Calif.

[73] Assignee: Chevron Research Company, San Francisco, Calif.

[21] Appl. No.: 971,576

[22] Filed: Dec. 20, 1978

[51] Int. Cl.[2] ..... C10G 25/04

[52] U.S. Cl. ..... 208/246

[58] Field of Search ..... 208/246, 245, 296

[56] References Cited

U.S. PATENT DOCUMENTS

| | | | |
|---|---|---|---|
| 2,791,540 | 5/1957 | Kimberlin, Jr. et al. | 208/246 |
| 2,917,452 | 12/1959 | Brooke et al. | 208/246 |
| 3,211,644 | 10/1965 | Clark | 208/245 |
| 3,490,865 | 1/1970 | Huxley | 208/245 |
| 3,620,969 | 11/1971 | Turnock et al. | 208/245 |
| 3,654,144 | 4/1972 | Collins | 208/245 |
| 3,725,299 | 4/1973 | Turnock et al. | 208/245 |
| 4,098,684 | 7/1978 | Innes | 208/245 |

FOREIGN PATENT DOCUMENTS

| | | | |
|---|---|---|---|
| 2624239 | 12/1977 | Fed. Rep. of Germany | 208/246 |

*Primary Examiner*—George Crasanakis

*Attorney, Agent, or Firm*—D. A. Newell; R. H. Davies; D. L. Hagmann

[57] ABSTRACT

Thiophenes are selectively removed from gasoline by contact thereof with a silver-exchanged faujasite-type zeolite.

7 Claims, No Drawings

SELECTIVE PROCESS FOR REMOVAL OF THIOPHENES FROM GASOLINE USING A SILVER-EXCHANGED FAUJASITE-TYPE ZEOLITE

BACKGROUND OF THE INVENTION

This invention relates to a process for selectively sorbing residual thiophene-type contaminants from gasoline using a silver-exchanged faujasite-type crystalline molecular sieve as the adsorbent.

The separation of thiophene from benzene, especially where thiophene is present as a trace or minor impurity, is well known as being a difficult separation. The selective separation of thiophene-type contaminants from gasoline, which normally has a substantial content of benzene and substituted benzene is, of course, also a difficult separation. Thiophenes are also one of the most, if not the most, difficult of impurities to remove from gasoline by conventional hydrotreatment of gasoline stocks. They are known to be present in minor yet significant amounts in gasoline stocks even after such a treatment.

It is an object of this invention to provide a non-hydrogenative (no added hydrogen gas) process for effectively removing thiophene-type contaminants from gasoline.

SUMMARY OF THE INVENTION

A process is provided for upgrading a gasoline feed containing residual thiophene-type contaminants comprising contacting said feed with a silver-exchanged faujasite-type crystalline aluminosilicate zeolite, said contacting being at (1) a temperature in the range of from about 20° to 370° C., (2) an LHSV, V/V/Hr, in the range of from about 0.1 to 20, and (3) an atmospheric or moderately superatmospheric pressure; and recovering the resulting gasoline having, relative to said feed, a substantially reduced content of said contaminants.

By "thiophene-type contaminants" is meant by definition thiophene and hydrocarbyl-substituted thiophenes indigenous to petroleum and syncrude oils and such, thiophenes and hydrocarbyl-substituted thiophenes resulting from conventional processing of such oils in the normal production of gasoline as in the hydrocarbon refining art.

EMBODIMENT

In a preferred embodiment, a hydrofined $C_5$-$C_6$ gasoline fraction having a content, calculated as sulfur, of residual thiophene-type, sulfur-containing impurities in the range below 100 ppmw is the feed for the process. This feed is contacted with a silver-exchanged ultrastable Y-sieve containing about 10 weight percent of silver under the following non-hydrogenative conditions:

Temperature, °C.—200

LHSV, V/V/Hr—0.2

The effluent product stream has a markedly reduced content of thiophene-type impurities. The capacity of the adsorbent is about 0.07 to 0.15 gram of sulfur per 100 grams of the adsorbent. For practical purposes, olefins present in the feed are unaffected by the contacting.

Feed

Gasoline-boiling-range hydrocarbon mixtures, and fractions thereof, containing residual thiophene-type contaminants are suitable feeds for the present process.

These contaminants are found to persist in the feed in significant (1 to 100 ppmw as sulfur) amounts even after conventional hydrofining (including hydrotreating and hydrodesulfurizing) of the feed. The present process is especially effective in upgrading $C_5$–$C_7$, $C_5$–$C_6$ and the like low-boiling gasoline-boiling-range fractions. These fractions are preferred feeds herein.

Conditions

The process herein may be carried out with the feed in the liquid, gas or liquid-and-gas phase. Other conditions include:

| | Broad | Preferred |
|---|---|---|
| Temperature, °C. | 20 to 370 | 200 to 350 |
| LHSV, V/V/Hr | 0.1 to 20 | 0.2 to 2 |

Adsorbent

Silver-exchanged faujasites, in general, are satisfactory for use as adsorbents in the process herein. The zeolite may be either natural or synthetic, the latter being preferred. The adsorbent should contain at least 0.5 weight percent of silver, and may contain as much as 40% and more. Preferred adsorbents contain an amount of silver in the range of from about 1 to 20, more preferably 2 to 15% of silver.

EXAMPLES

The following examples are only intended for the further illustration of the invention.

EXAMPLE 1

In this example, the feed was a narrow-boiling hydrofined $C_5$–$C_6$ gasoline cut to which was added 20 volume percent of $C_5$–$C_6$ olefins and 100 ppmw (as sulfur) of thiophene. The feed was contacted with a silver-Y-sieve adsorbent containing 33.5 weight percent of silver. Under ambient conditions (ca. 22° C. and 1 atmosphere pressure) and a liquid hourly space velocity (V/V/Hr) of about 0.2, thiophene was effectively removed for about 20 hours. Increasing the temperature thereafter to 371° C. had no beneficial effect. The olefins in the product were unchanged at 20% during the run. Calculated as sulfur, the adsorbent had a thiophene capacity of about 0.07–0.15 weight percent.

EXAMPLE 2

Using the same feed, a silver-exchanged ultrastable Y-sieve containing 9.7 weight percent of silver was used as the thiophene adsorbent. It had a somewhat better capacity (ca. 0.2% by weight) than the ordinary Y-sieve (faujasite). It also responsed by additional adsorption as a result of increasing the temperature. A fraction (about 25%) of the olefins appeared to be lost during the run.

These examples demonstrate that silver-exchanged (that is, by well-known conventional exchanging techniques of the zeolite art) faujasites are effective adsorbents for the removal of residual thiophene-type contaminants in a gasoline or fraction thereof.

What is claimed is:

1. A process for upgrading a hydrofined gasoline feed containing residual thiophene-type contaminants comprising contacting said feed with a silver-exchanged faujasite-type crystalline aluminosilicate zeolite, said contacting being at (1) a temperature in the range of from about 20° to 370° C., and (2) an LHSV, V/V/Hr, in the range of from about 0.1 to 20; and recovering the resulting gasoline having, relative to said feed, a substantially reduced content of said contaminants.

2. A process as in claim 1 wherein said feed is a gasoline fraction of $C_5$–$C_7$ cut.

3. A process as in claim 2 wherein said fraction is a $C_5$–$C_6$ cut.

4. A process as in claim 1 wherein said faujasite-type zeolite is an ultra-stable Y-sieve.

5. A process as in claim 1 wherein said zeolite contains an amount of silver in the range of from about 0.5 to 40 weight percent.

6. A process as in claim 5 wherein said amount of silver is in the range of 2 to 15%.

7. A process as in claim 1 wherein said feed contains an appreciable amount of olefins and the resulting gasoline contains substantially the same amount of olefins.

* * * * *